US011761217B2

(12) United States Patent
Curtis

(10) Patent No.: US 11,761,217 B2
(45) Date of Patent: Sep. 19, 2023

(54) SCAFFOLD GATE TOEBOARD ASSEMBLY FOR USE ON A SCAFFOLD GATE

(71) Applicant: Deltak Manufacturing, Inc., Walker, LA (US)

(72) Inventor: Johnny Curtis, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 295 days.

(21) Appl. No.: 16/852,401

(22) Filed: Apr. 17, 2020

(65) Prior Publication Data

US 2021/0047846 A1 Feb. 18, 2021

Related U.S. Application Data

(63) Continuation of application No. PCT/US2019/028146, filed on Apr. 18, 2019.

(60) Provisional application No. 62/660,653, filed on Apr. 20, 2018.

(51) Int. Cl.
*E04G 5/14* (2006.01)
*E04G 7/02* (2006.01)

(52) U.S. Cl.
CPC ..... *E04G 5/145* (2013.01); *E04G 5/141* (2013.01); *E04G 7/02* (2013.01)

(58) Field of Classification Search
CPC ..... E04G 5/14; E04G 5/145; E04G 5/141; E04G 7/02; E06B 11/00; E06B 11/02; E06B 11/022; E06B 11/023; E06B 11/026; E06B 11/028; E06B 11/08; E06B 11/085; B66F 11/044
USPC ..... 49/50, 55, 56, 57
See application file for complete search history.

(56) References Cited

U.S. PATENT DOCUMENTS 3,297,076 A * 1/1967 Udin ..... E06B 9/0661 160/161
3,425,165 A * 2/1969 Cleveland ..... E04G 21/3219 52/645
3,480,257 A * 11/1969 Bourn ..... E04G 5/045 182/113
3,785,602 A * 1/1974 Juculano ..... F16B 2/248 182/113
3,844,520 A * 10/1974 Werner ..... E04G 5/14 248/228.3

(Continued)

FOREIGN PATENT DOCUMENTS

DE 202015000707 U1 3/2015
DE 202015000707 U1 * 4/2015 ..... E04G 5/10

(Continued)

OTHER PUBLICATIONS

PCT/US2019/028146—see the Written Opinion of the International Searching Authority (dated Jul. 10, 2019), International Search Report (Jul. 10, 2019).

*Primary Examiner* — Daniel P Cahn
*Assistant Examiner* — Shiref M Mekhaeil
(74) *Attorney, Agent, or Firm* — Intellectual Property Consulting, LLC; Bernard F. Meroney

(57) ABSTRACT

A scaffold toeboard assembly including a toeboard frame having a toeboard coupled to a riser with a first and second end, with a lift handle coupled to the first end, and a toeboard coupled to the second end. The assembly further including a support frame having a vertical support with an attachment member configured to couple to a scaffold swing gate, wherein the riser is slidably coupled to the vertical support.

10 Claims, 5 Drawing Sheets

(56) References Cited

U.S. PATENT DOCUMENTS 3,920,221 A * 11/1975 Berry ..... E04G 21/3233 52/707
4,236,698 A * 12/1980 Compte ..... E04G 21/3223 182/113
4,243,090 A * 1/1981 Kemp ..... E06B 9/063 160/145
4,492,263 A * 1/1985 Gebhard ..... E06B 9/02 160/222
4,628,635 A * 12/1986 Maillard ..... E06B 9/02 49/55
4,630,396 A * 12/1986 Zvi ..... E06B 9/04 49/55
5,070,647 A * 12/1991 Spialter ..... E06B 9/02 49/141
5,145,030 A * 9/1992 Pavlescak ..... E04G 5/14 182/113
5,241,789 A * 9/1993 Vacelet ..... E04G 21/3223 49/248
6,443,262 B1 * 9/2002 Karanouh ..... E04G 5/10 182/178.1
6,499,254 B2 * 12/2002 Rossman ..... A01K 1/0017 49/57
6,976,557 B2 * 12/2005 Becker ..... E04G 5/141 182/113
7,963,367 B2 * 6/2011 Wilson ..... E04G 7/28 256/65.01
8,196,348 B2 * 6/2012 Flannery ..... E06B 9/04 49/55
8,347,555 B2 * 1/2013 Chen ..... E05B 47/004 49/55
8,973,707 B2 * 3/2015 Kreller ..... E04G 7/28 182/112
9,027,712 B2 * 5/2015 Melton ..... B65G 69/22 182/36
9,051,746 B2 * 6/2015 Rogers ..... E04G 5/08
9,194,090 B2 * 11/2015 Raml ..... E01F 7/025
9,273,475 B1 * 3/2016 DuBose ..... B60P 1/00
9,382,740 B2 * 7/2016 Flannery ..... E05D 7/10
9,382,750 B1 * 7/2016 Flannery ..... E05C 3/16
9,874,055 B1 * 1/2018 Flannery ..... E06B 11/02
9,879,453 B1 * 1/2018 Flannery ..... E06B 3/52
10,907,404 B1 * 2/2021 Flannery ..... E05D 15/58
11,035,173 B1 * 6/2021 Flannery ..... E05D 7/08
11,072,973 B2 * 7/2021 Flannery ..... E06B 9/04
11,162,300 B1 * 11/2021 Flannery ..... E05C 3/167
2004/0182006 A1 * 9/2004 Petty ..... E06B 9/04 49/56
2005/0189173 A1 * 9/2005 Becker ..... E04G 7/28 182/113
2007/0052249 A1 * 3/2007 Nesseth ..... E05B 53/003 292/254
2007/0245631 A1 * 10/2007 Yi ..... E06B 9/0661 49/55
2008/0265233 A1 * 10/2008 Flannery ..... E06B 9/04 256/73
2009/0217591 A1 * 9/2009 LaCook ..... E04G 5/144 49/50
2009/0293363 A1 * 12/2009 Flannery ..... E06B 7/32 49/55
2019/0234139 A1 * 8/2019 Flannery ..... E05B 65/0007

FOREIGN PATENT DOCUMENTS

EP 1867806 A1 * 12/2007 ..... E04G 5/14
EP 1867806 A1 12/2007
GB 2324328 A * 10/1998 ..... E04G 1/152
GB 2326436 A * 12/1998 ..... E04G 5/14
GB 2336391 A * 10/1999 ..... E04G 5/14
GB 2412140 A * 9/2005
GB 2484395 A * 4/2012 ..... E04G 5/14
GB 2497560 A * 6/2013 ..... E04G 5/14
GB 2554160 A * 3/2018 ..... E04G 21/3204
WO 0077324 A1 12/2000
WO 2018049477 A1 3/2018

* cited by examiner

PARTS BREAKDOWN

ASSEMBLED VIEW

SECTION "A"-"A"

TOP VIEW

FRONT VIEW

SCAFFOLD GATE TOEBOARD ASSEMBLY FOR USE ON A SCAFFOLD GATE

This application claims the priority benefit of U.S. Provisional 62/660,653 filed on Apr. 20, 2018, which application is incorporated in its entirety by reference.

TECHNICAL FIELD

This invention relates to scaffolding, and in particular, to scaffold toeboard systems.

BACKGROUND ART

Scaffold structures generally have a framework of horizontal scaffold members ("horizontal members" or "horizontals") and vertical scaffold members ("vertical members" or "verticals") which create a structure for supporting an elevated platform work area. The platform decking generally consists of scaffold boards, constructed of either metal or wood supported at an elevation by the scaffold frame. The Occupational Safety and Health Administration (OSHA) requires all scaffold decks to include "toeboards." Toeboards are boards that attach to the scaffold structure near the outer perimeter or edges of the work platform and function to keep materials from falling or rolling off the work platform. Toeboards can also be used to secure the platform deck to the scaffold frame.

One general practice is to use 2×4 or 2×6 lumber as toeboards. These wooden toeboards may be nailed to the platform or wired to the platform with tie wraps or bailing wire. As the work platform can vary in size, each platform requires toeboards to be cut to size on the job site, or that various standard sizes are kept in stock. Much scaffolding is exposed to weather. Due to weathering, wooden toeboards may be used several times, and then have to be discarded. Metal toeboards are available, such as metal boards that couple to a stub member or sleeve that attaches to a vertical scaffold member, such as described in U.S. Pat. No. 6,405,830, hereby incorporated by reference.

The scaffold elevated work platforms are accessible by climbing a ladder attached to the scaffold structure. Near the top of the ladder is an access opening through the scaffold platform's existing safety railing system. To close the access opening, a swing gate 1050 is often provided, attached to a vertical scaffold member 7000 in the railing system. See FIG. 1. The swing gate 1050 is normally spring biased to a closed position, and preferably has a top rail 1000, a bottom rail 2000, and two side rails 3000, and a stop 1400 located on the side rail opposite the spring biased hinge 5000. The gate 1050, when closed, prevents falls through the access opening. In the area of the access opening, toeboards are not normally employed because they would present a drop hazard in this area.

SUMMARY AND OBJECTS OF THE INVENTION

One embodiment of the invention is a scaffold toeboard assembly. The assembly includes a toeboard frame having a toeboard coupled to a riser with a first and second end, with a lift handle coupled to the first end, and a toeboard coupled to the second end. The assembly further includes a support frame having a vertical support with an attachment member configured to couple to a scaffold swing gate, wherein the riser is slidably coupled to the vertical support.

It is an object of the invention to provide a scaffold toeboard attached to or integrated into and moveable with a swing gate, where the toeboard can be raised with respect to the swing gate.

DETAILED DESCRIPTION OF AN EMBODIMENT OF THE INVENTION

Figure 1:
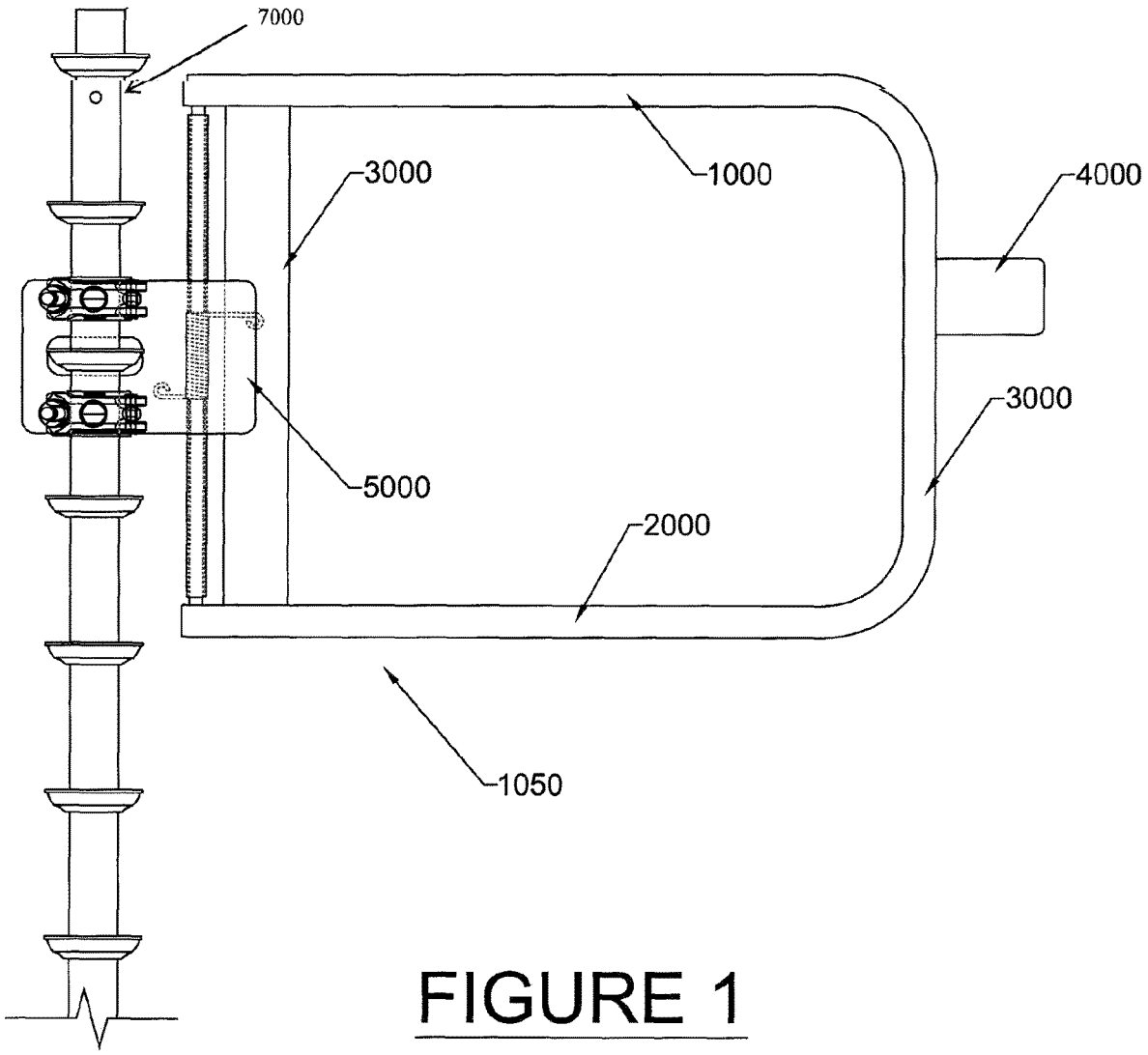
FIGURE 1 PRIOR ART
FIG. 1 is a side elevation view of a prior art swing gate attached to a scaffold vertical member.
Figure 2:
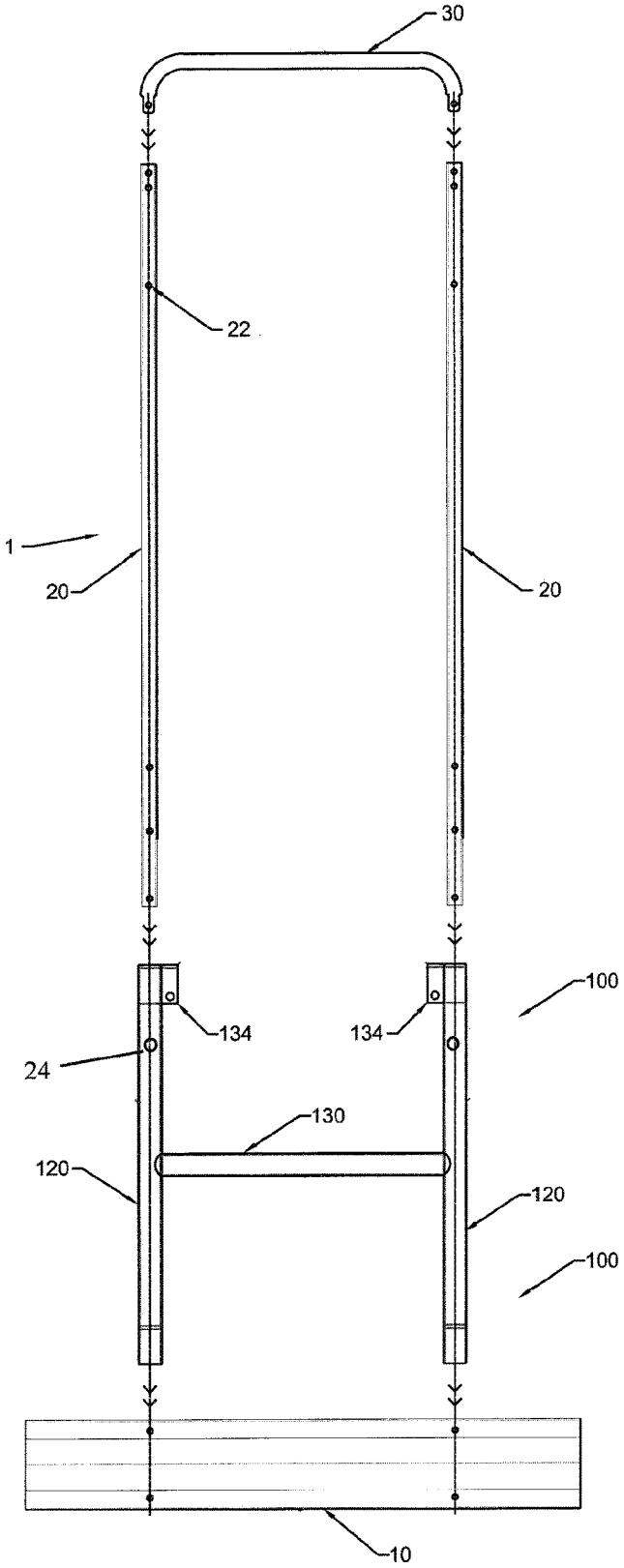
FIG. 2 is an exploded view of one embodiment of the scaffold gate toeboard assembly of the present invention.
Figure 4:
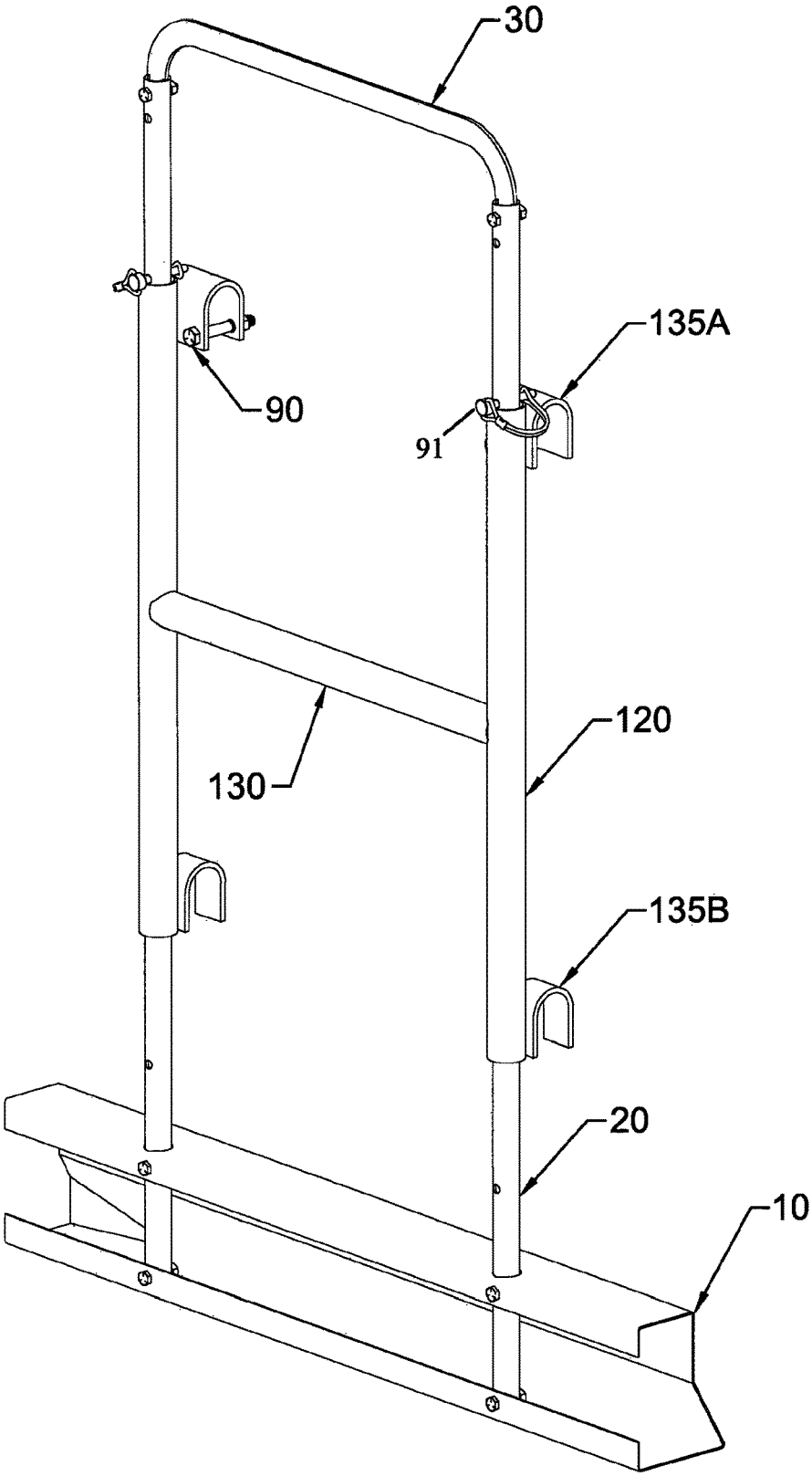
FIG. 4 is a perspective view of another embodiment of an assembled toeboard system.

One embodiment of the invention includes a scaffold gate toeboard assembly (also simply "toeboard assembly") for attachment to a swing gate, where the assembly includes a toeboard that can be raised off the scaffold floor to open and close the gate unimpeded. One such assembly is shown in FIG. 2 and includes a toeboard frame 1 and a support frame 100. The toeboard frame 1 shown comprises a toeboard 10 formed from an elongated member having a first end and a second end. The toeboard 10 may be integral with the toeboard frame 1, or may be a separate member coupled to the toeboard frame 1. One end of the toeboard 10 may be cut at an angle (not shown) to avoid potential interference with the adjacent vertical scaffold member when the gate is opened. Both ends of the toeboard 10 could be so cut to avoid the need for right handed and left handed embodiments. The toeboard 10 may be a "C" shaped metal or wooden board, an "I" shaped board (metal or wooden), a flat plate or a curved plate, or other suitably shaped member, such as shown in FIG. 4. The toeboard 10 is coupled to right and left vertical risers 20 (here shown as tubes or pipes). Each riser has one or more openings 22 therethrough, near the upper end of the riser 20 on the inward face of the riser, to accommodate a positioning member 91 (explained in more detail below). If multiple openings are present, they will often be in a vertical row, spaced about 1.2 inches apart. The openings 22 are aligned vertically in the risers 20 to accommodate the positioning pin 91. Attached to the top of the risers 20 is a lifting handle 30. The handle 30 may be irremovably coupled to the risers 20, integrally formed, or fixedly attached (e.g., with bolts through holes in handle 30 and the top of risers 20). The handle may be a shaped tube member as show in FIG. 2, or a flat plate, or other suitable shape. In the embodiment shown, the toeboard frame 1 includes the toeboard 10, risers 20 and lifting handle 30 joined or coupled into a unitary member (i.e. all the components move together with associated couplings). The components may be separate members, but the assembled system is unitary, as all components move as a unit.

The toeboard frame 1 is slidably coupled to the support frame 100, and the support frame 100 can be irremovably or removably coupled to the swing gate 1050 (e.g., see FIG.

Figure 3A:
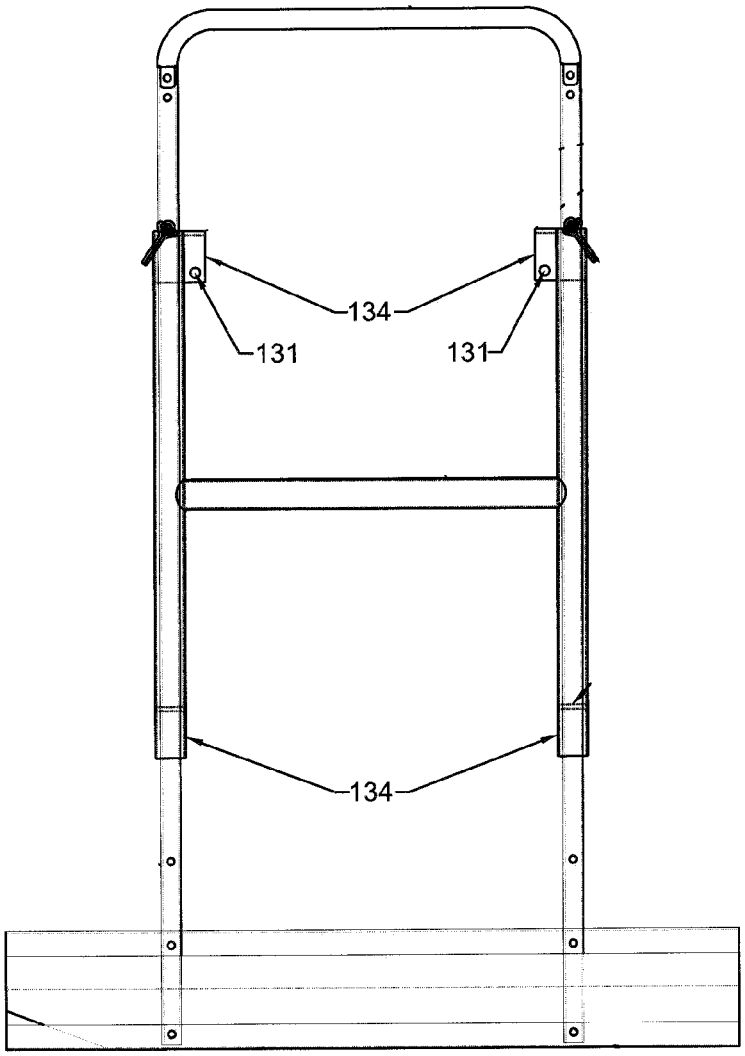
FIG. 3A is an assembled view of the scaffold gate toeboard assembly of FIG. 2 ready for attachment to a scaffold gate.

5A). The support frame 100 shown in FIG. 2 includes right and left vertical supports 120 (shown as hollow tubular members), on (into) which the right and left risers 20 will be slidably positioned (if tubes are used as supports, as shown, the risers preferably will be slidable in the interior of the hollow tubular vertical supports 120). The left and right vertical supports are preferably joined together by brace member 130 for strength, thereby forming an "H-shaped" support frame. The left and right vertical supports 120 include attachment members, such as clamps, to fixedly attach the support frame 100 to the top rail 1000 and/or bottom rail 2000 of a swing gate 1050. In the embodiment shown in FIGS. 3A and 3B, the attachment members are gate hooks 135, including upper 135A and lower 135B gate hooks. As shown in FIG. 4, the gate hooks 135 are shaped to engage the swing gate top rail 1000 and/or bottom rail 2000 (as shown "U" or C" shaped hooks). In other embodiments, some or all of the gate hooks may be moveable, such as the upper gate hook 135A. To accomplish this, the gate hook 135 is fixedly attached to a sleeve 131 that is slidable over a vertical support 120 as suggested in the embodiment of FIG. 3. The sleeves 131 for the upper gate hooks 135A are slidable over the respective vertical supports 120. The lower sleeves 131 associated with the bottom gate hooks 135B may be slidable on or fixedly positioned on the vertical support 120. The lower gate hook 135B (and associated sleeve 131, if used), may be directly attached to the vertical support 120, near the lower end of the vertical support 120. The sleeves 131 may include a tab 134 that extends outwardly at ninety degrees from the gate hook 135, preferably with a hole through the tab positioned below the terminating end of the gate hook 135. The hole will accommodate a lock member 90, such as a bolt or pin, in order to fix the support frame 100 assembly to the swing gate 1050, as later described.

To assemble the swing gate toeboard assembly, the toeboard frame 1 is coupled to the support frame 100. If sleeves 131 are used, the lower and upper sleeves 131 will be positioned a vertical distance spaced apart substantially equal to the distance between the upper 1000 and lower 2000 rails of a swing-gate 1050. The sleeves 131 with associated hooks will be placed on the vertical supports 120 prior to a completed coupling of the vertical support 120 with the risers 20. Note that the lower hook 135B and associated sleeve 131 may be fixed to the vertical supports 120 (e.g., permanently by welding or non-permanently by a set-screw engaging the vertical support through the sleeve). To assemble the two frames together, either the lifting handle 30 or the toeboard 10 (or both) should be removed from the risers 20. The risers 20 are then slid into the interior of the vertical supports 120, and the lifting handle 30 (if unattached) and toeboard 10 are then the coupled to risers 20.

Another embodiment of an assembled scaffold gate toeboard assembly is shown in FIG. 4. As shown in this embodiment, the gate hooks 135A and 135B are fixedly joined to the vertical supports 120, such as by welding. No sleeves 131 are utilized. Lock member 90 in this embodiment is a bolt, extending through at least one of the gate hooks 135, as the hooks are wide enough to extend beyond the coupled risers 20. In this embodiment, the gate hooks must have sufficient area interior to lock member 90 to accommodate the diameter of a gate rail 1000 or 2000.

Figure 3B:
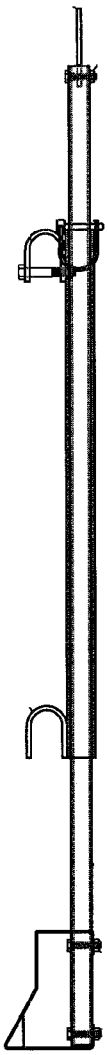
FIG. 3B is a side view of the toeboard assembly of FIG. 3A.
Figure 5B:
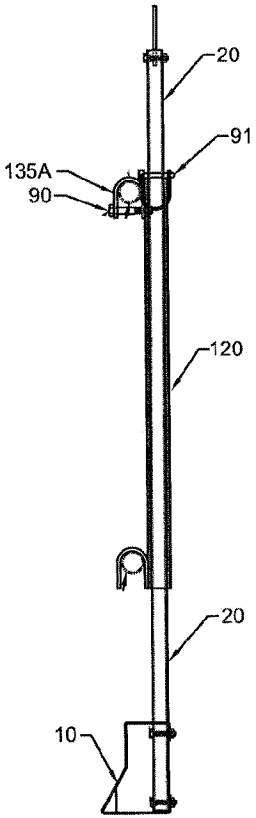
FIG. 5B is a side view of the toeboard system of FIG. 5A.
Figure 5C:
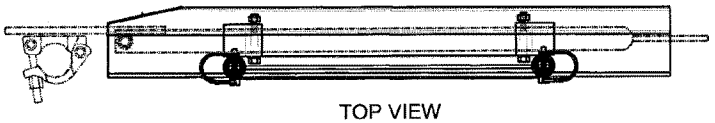
FIG. 5C is a top view of the toeboard system of FIG. 5A.
Figure 5A:
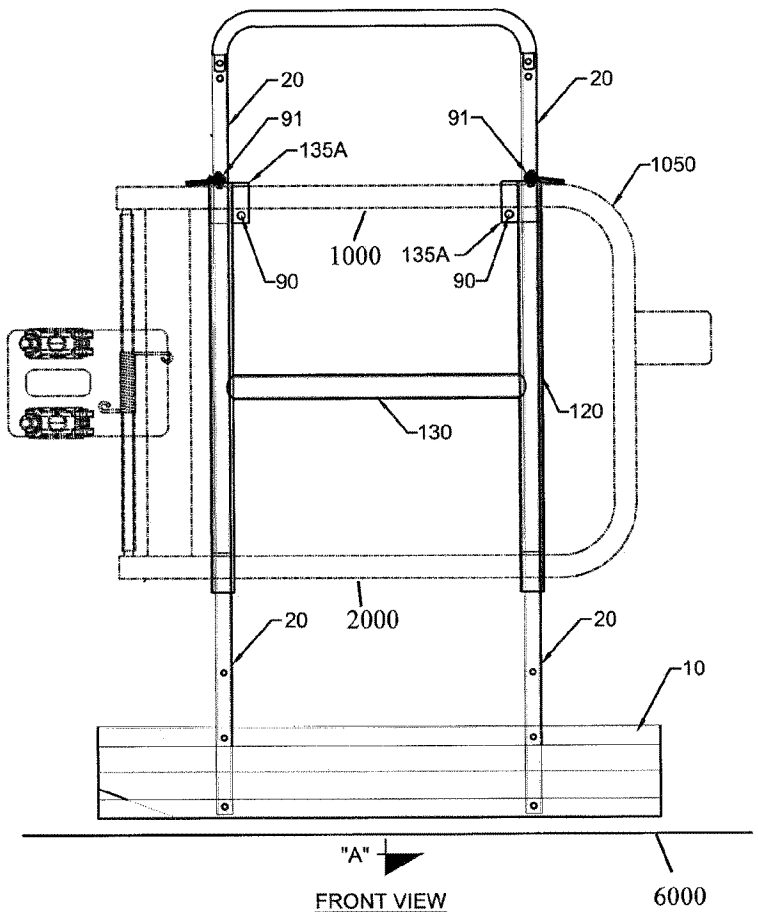
FIG. 5A is a front view of the toeboard system of FIG. 4, coupled to a swing gate.

To attach the assembled toeboard assembly to a swing gate as suggested in FIGS. 5A and 5B, the attachment members (gate hooks 135 in the embodiment shown) are coupled to the top gate rail 1000 and/or the bottom gate rail 2000. The upper hooks 135A and associated sleeves 131 (if present) are slid onto the vertical supports 120, (thereby allowing adjustability of the upper gate hooks in order to accommodate variations in distances between the top and bottom gate rails). To couple the assembled toeboard assembly to the gate 1050, a lock member 90 is used. In the embodiment shown in FIG. 4, the lock member 90 is a bolt or a pin that is inserted through the opening in the gate hook. In the FIG. 3 embodiment, the gates hooks themselves do not have holes, but a bolt may extend through the opening in the tab 134 in order to secure the gate rail between the gate hook and bolt. Preferably, the bolt or pin should be long enough to extend beyond a gate rail. As shown in FIG. 3B, the bolt 90 is in the lower portion of the gate hook 135A. A bolt or pin inserted in this manner will be positioned below the associated gate rail (see FIG. 5B), thereby preventing removal of the toeboard assembly from the swing gate 1050. Other lock members could be employed, such as clamps, for instance a U clamp.

The above assembly contemplates the support frame 100 and toeboard frame 10 being coupled together and then the entire assembly being mounted on swing gate 1050. However, as an alternative, the support frame 100 may be first coupled to a swing gate 1050, and then the toeboard frame 10 slidably coupled to the support frame 100. It will be understood that as long as lower gate hooks 135B are fixed in their vertical position on vertical supports 120, upper gate hooks 135A on sleeves 131 do not require the sleeves to be vertically fixed on the vertical supports 120. When the upper hooks 135A and lower hooks 135B are locked to their respective gate rails, the toeboard assembly will be securely fixed to the scaffold swing gate.

At this point, the toeboard assembly is positioned and locked onto the swing gate 1050. Because the risers 20 extend through the vertical supports 120, the toeboard frame 1 is slidable with respect to the swing gate 1050. When the swing gate is closed, the toeboard 10 will rest on the top surface of the scaffold decking since the risers 20 are free to slide up or down in the vertical supports 120. To open the swing gate, the lift handle 30, now positioned above the top rail of the swing gate, is lifted upwardly, allowing the coupled toeboard frame 1 and the attached toeboard 10, to be raised up with respect to the gate 1050. This raises the toeboard 10 off the scaffold deck 6000 as suggested in FIG. 5A, creating a gap between the toeboard 10 and the deck, thereby allowing the swing gate to swing inwardly without dragging the toeboard 10 across the decking. To close the gate 1050, the lift handle 30 is again lifted, allowing the swing gate to be closed without dragging the toeboard 10 across the deck. If the operator prefers that the toeboard be fixed at a height above the decking, for instance, about a half inch above the decking, the toeboard lift handle does not need to be raised to open or close the swing gate. In one embodiment, to keep the toeboard off the floor, the handle is lifted until the holes 24 in the vertical supports 120 aligns with a suitable holes 22 in the risers 20 (e.g., see holes 22 and 24 in FIG. 2). At this point, a position member 91 (here a pin with a retaining clip as shown in FIG. 3 or 4) is inserted through the aligned openings, fixing the position of the assembly with respect to the swing gate 1050 with the toeboard 10 slightly raised vertically above the deck, creating a small gap, and allowing the toeboard to be free of the deck, but still to block all but the smallest item. Alternatively, in the embodiment shown in FIG. 4, no holes are needed in the vertical supports 120. Instead, the handle is lifted until the hole 22 in the riser 20 appears above the vertical support 120, and the toeboard is positioned off the deck as desired. The position member 91, (here a pin with a retaining clip, (or a bolt or cotter pin)) is then inserted in the raiser 20 opening, fixing the position of the toeboard 10 above the deck, as desired, since the positioning member prevents any further downward movement of the toeboard frame 1. The assembled scaffold swing gate toeboard assembly of the FIG. 4 embodiment mounted on the swing gate is depicted in FIG. 5.

Other embodiments of the system are within the scope of the invention. Instead of dual risers, a single riser could be used in a single support. Instead of tubular supports, the support(s) could be a plate member with "U" shaped or "D" shaped loops attached to the plate (e.g., near the top and bottom of the plate), through with the risers would be slidable. The risers could be cables or ropes, or solid bars or rods, or plates. In the case of a cable or rope, the cable/ropes preferably could be threaded through a lockable pulley or pulley hoist, mounted for instance, on the top rail of the gate. When the pulley is locked in place with the toeboard slightly lifted off the deck, the locked pulley functions as the position pin 91 described above. If clamps are used to couple the support frame to the swing gate, either the upper gate hooks, the lower gate hooks, or both could be eliminated. Additionally, the structure could be permanently attached to the gate, making it integral with the gate (such as by welding the supports to the gate). Other variations will be apparent to those skilled in the art, and are intended to be included in the scope of the following claims.

What is claimed is:

1. A scaffold toeboard assembly in combination with a scaffold swing gate, wherein the swing gate includes a top rail, a bottom rail, and two side rails, the toeboard assembly comprising:

a) a support frame including (i) two tubular vertical supports joined by a brace member, (ii) an upper gate hook on each vertical support engaging the swing gate top rail, and (iii) a lower gate hook on each vertical support engaging the swing gate bottom rail; and b) a toeboard frame including (i) a vertical riser extending through each of the tubular vertical supports of the support frame, (ii) a handle connecting an upper end of each tubular vertical riser, and (iii) a toeboard connected approximately to a lower end of the vertical risers.

2. The scaffold toeboard assembly of claim 1, wherein the two vertical supports and the brace member form a substantially H-shaped support frame.

3. The scaffold toeboard assembly of claim 1, further comprising a lock member connected to each of the gate hooks and which is configured to secure the gate hooks from disengagement with the top and bottom swing gate rails.

4. The scaffold toeboard assembly of claim 3, wherein the lock member is a bolt or pin extending through the gate hooks.

5. The scaffold toeboard assembly of claim 1, wherein a positioning member engages each vertical riser in order to limit downward movement of the vertical risers relative to the support frame.

6. The scaffold toeboard assembly of claim 5, wherein the positioning members are bolts or pins engaging the vertical risers above the vertical supports of the support frame.

7. The scaffold toeboard assembly of claim 5, wherein the positioning members are bolts or pins engaging the vertical risers through holes in the vertical supports of the support frame.

8. A scaffold system including a toeboard assembly in combination with a scaffold swing gate positioned over a scaffold decking, wherein the swing gate includes a top rail, a bottom rail, and two side rails, the toeboard assembly comprising:

a) a support frame including (i) two tubular vertical supports joined by a brace member, (ii) an upper gate hook on each vertical support engaging the swing gate top rail, and (iii) a lower gate hook on each vertical support engaging the swing gate bottom rail;

b) a toeboard frame including (i) a vertical riser extending through each of the tubular vertical supports of the support frame, (ii) a handle connecting an upper end of the vertical risers, and (iii) a toeboard connected approximately to a lower end of the vertical risers; and c) wherein the handle of the toeboard frame is configured to raise the toeboard relative to the scaffold decking.

9. The scaffold system of claim 8, wherein a positioning member engages each vertical riser at a location which holds the toeboard less than three inches off the scaffold decking.

10. The scaffold system of claim 8, wherein the lower gate hooks are fixed to the vertical supports and the upper gate hooks are slidingly attached to the vertical supports.

* * * * *